US010774706B2

(12) United States Patent
Ishikawa et al.

(10) Patent No.: US 10,774,706 B2
(45) Date of Patent: Sep. 15, 2020

(54) INTERNAL COMBUSTION ENGINE

(71) Applicant: TOYOTA JIDOSHA KABUSHIKI KAISHA, Toyota-shi, Aichi-ken (JP)

(72) Inventors: Masami Ishikawa, Aichi-gun (JP); Kosuke Sogawa, Chiryu (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 16/601,873

(22) Filed: Oct. 15, 2019

(65) Prior Publication Data

US 2020/0123944 A1 Apr. 23, 2020

(30) Foreign Application Priority Data

Oct. 23, 2018 (JP) ..... 2018-198993

(51) Int. Cl.

| | |
|---|---|
| ***F01M 13/04*** | (2006.01) |
| ***F02M 25/06*** | (2016.01) |
| ***F02M 35/10*** | (2006.01) |
| ***F02D 9/08*** | (2006.01) |

(52) U.S. Cl.

CPC ..... *F01M 13/04* (2013.01); *F02D 9/08* (2013.01); *F02M 25/06* (2013.01); *F02M 35/10006* (2013.01); *F02M 35/1038* (2013.01); *F02M 35/10209* (2013.01)

(58) Field of Classification Search

CPC .. F01M 13/04; F02M 25/06; F02M 35/10006; F02M 35/10209; F02M 35/1038; F02D 9/08

See application file for complete search history.

(56) References Cited

U.S. PATENT DOCUMENTS

| | | | | |
|---|---|---|---|---|
| 6,098,603 | A | 8/2000 | Maegawa et al. | |
| 6,247,464 | B1 | 6/2001 | Maegawa et al. | |
| 9,523,297 | B2 * | 12/2016 | Kitagawa | F01M 13/0416 |
| 2001/0010214 | A1 | 8/2001 | Maegawa et al. | |
| 2006/0059875 | A1 * | 3/2006 | Malgorn | B01D 45/08 55/468 |
| 2015/0240732 | A1 * | 8/2015 | Makihara | F02D 41/0025 60/602 |

FOREIGN PATENT DOCUMENTS

| | | |
|---|---|---|
| JP | 03-172524 | 7/1991 |
| JP | 10-184336 | 7/1998 |
| KR | 20080043474 A * | 5/2008 |

* cited by examiner

*Primary Examiner* — Hung Q Nguyen
(74) *Attorney, Agent, or Firm* — Finnegan, Henderson, Farabow, Garrett & Dunner, LLP

(57) ABSTRACT

An internal combustion engine includes a blow-by gas treating device. The blow-by gas treating device includes a separator having a line connection portion. The line connection portion includes an intake connection union, to which an intake connection line is attached, a sensor connection union, to which a pressure sensor is connected, a partition plate, which divides the space in the separator into a first space and a second space, and a constriction, which is provided in the partition plate and allows the first space and the second space to communicate with each other. The line connection portion is constituted by combining a first unit, which includes the partition plate and defines the first space, and a second unit, which defines the second space with the partition plate of the first unit. The intake connection union and the sensor connection union are provided in the second unit.

6 Claims, 4 Drawing Sheets

INTERNAL COMBUSTION ENGINE

BACKGROUND

1. Field

The present disclosure relates to an internal combustion engine provided with a blow-by gas treating device.

2. Description of Related Art

Japanese Laid-Open Patent Publication No. 10-184336 discloses an internal combustion engine provided with a blow-by gas treating device. The blow-by gas treating device includes a blow-by gas passage and a communicating passage. The blow-by gas passage connects a section of the intake passage on the downstream side of the throttle valve to the head cover. The communicating passage connects a section of the intake passage on the upstream side of the throttle valve to the head cover. The internal combustion engine has a pressure sensor that detects an anomaly in the blow-by gas treating device such as line disconnection. Specifically, the pressure sensor provided in the blow-by gas passage detects the pressure in the blow-by gas passage. An anomaly is detected based on a change in the detected pressure.

In a configuration that detects line disconnection based on a change in the pressure detected by a pressure sensor, line disconnection cannot be detected if a change in the pressure before and after the line disconnection is small enough to be within the range in which it is determined that anomaly is not occurring.

For example, assume that a section of the intake passage on the downstream side of the throttle valve is at a negative pressure during operation of the internal combustion engine. If the blow-by gas passage is disconnected at the joint with the intake passage, the blow-by gas passage is opened. If a pressure sensor is provided in the blow-by gas passage as in the case of the internal combustion engine described in the above publication, line disconnection can be detected since the detection value of the pressure sensor is changed to approach the atmospheric pressure. In contrast, if the blow-by gas passage is disconnected at the joint with the head cover, the blow-by gas passage, to which the pressure sensor is connected, is maintained to be connected to the section of the intake passage on the downstream side of the throttle valve. If the pressure sensor is maintained to be connected to the section of the intake passage on the downstream side of the throttle valve, there is only a small change in the pressure before and after line disconnection occurs. Line disconnection thus may be undetectable.

Also, in a case in which a pressure sensor is provided in a passage connected to a section of the intake passage on the upstream side of the throttle valve as in the case of the communicating passage of the internal combustion engine described in the above publication, line disconnection may be undetectable. For example, assume that the interior of the head cover is at a negative pressure during operation of the internal combustion engine. When the communicating passage is disconnected at the joint with the intake passage while the communicating passage and the head cover are maintained to communicate with each other, there is only a small change in the pressure before and after the occurrence of line disconnection. Line disconnection thus may be undetectable.

As described above, depending on the location where line disconnection occurs, a change in the detection value of the pressure sensor is small, and the line disconnection may be undetectable.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In a general aspect, an internal combustion engine including a blow-by gas treating device is provided. The blow-by gas treating device includes a blow-by gas passage, a separator, an intake connection line, and a pressure sensor. The blow-by gas passage is configured to release blow-by gas that has leaked to a crankcase from a combustion chamber of the internal combustion engine to a section of an intake passage that is on a downstream side of a throttle valve. The separator is configured to separate oil from the blow-by gas. The intake connection line connects the intake passage to the separator. The pressure sensor is configured to detect pressure in the intake connection line. The separator includes a line connection portion. The line connection portion includes an intake connection union, a sensor connection union, a partition plate, and a constriction. The intake connection union is attached to the intake connection line. The pressure sensor is connected to the sensor connection union. The partition plate divides a space in the separator into a first space and a second space. The constriction is provided in the partition plate and allows the first space and the second space to communicate with each other. The line connection portion is constituted by combining a first unit, which includes the partition plate and defines the first space, and a second unit, which defines the second space with the partition plate of the first unit. The intake connection union and the sensor connection union are provided in the second unit.

With the above-described line connection portion, the sensor connection union, to which the pressure sensor is connected, is provided at a position closer to the intake connection union than the constriction. Thus, in both of a case in which the intake connection line is disconnected at the joint with the intake passage and a case in which the intake connection line is disconnected at the joint with the line connection portion, the part in which the sensor connection union is provided is exposed to the atmosphere after the intake connection line is disconnected. The detection value of the pressure sensor thus readily approaches the atmospheric pressure. That is, when the intake connection line is disconnected, the line disconnection is detected through a change in the detection value of the pressure sensor.

In one example of the above-described internal combustion engine, when the internal combustion engine is in a position of being mounted, the sensor connection union is located vertically above the constriction.

In the internal combustion engine of the above-described configuration, oil can enter the line connection portion when the blow-by gas that has leaked to the crankcase from the combustion chamber flows toward the intake connection line. This may cause the oil to collect on the pressure sensor, reducing the detection sensitivity of the pressure sensor.

With the above-described configuration, the sensor connection union is located vertically above the constriction even if oil enters the second space after passing through the constriction together with blow-by gas. This prevents the oil that has entered the second space from reaching the pressure sensor after passing through the sensor connection union. Accordingly, oil is prevented from collecting on the pressure sensor. That is, the above-described configuration limits reduction in the detection sensitivity of the pressure sensor and thus limits reduction in the detection sensitivity to line disconnection due to reduction in the detection sensitivity of the pressure sensor.

In one example of the above-described internal combustion engine, a central axis of an opening of the constriction is defined as a first central axis, and a central axis of the sensor connection union is defined as a second central axis. The constriction and the sensor connection union are arranged at positions where the first central axis and the second central axis are displaced from each other.

The above-described configuration prevents blow-by gas from directly flowing into the sensor connection line after flowing into the second space through the constriction. In other words, the blow-by gas that flows into the second space after passing through the constriction readily strikes the inner wall of the second unit. This allows oil to be separated from the blow-by gas, thereby limiting reduction in the detection sensitivity of the pressure sensor due to the flow of blow-by gas containing oil toward the pressure sensor. That is, the above-described configuration limits reduction in the detection sensitivity to line disconnection due to reduction in the detection sensitivity of the pressure sensor.

In one example of the above-described internal combustion engine, a central axis of the intake connection union is defined as a third central axis. The constriction, the sensor connection union, and the intake connection union are arranged at positions where any two of the first central axis, the second central axis, and the third central axis do not intersect with each other.

The above-described configuration prevents blow-by gas from directly flowing into the sensor connection line after flowing into the second space through the constriction. Also, the above-described configuration prevents blow-by gas from directly flowing into the intake connection line after flowing into the second space through the constriction. That is, the blow-by gas that flows into the second space after passing through the constriction readily strikes the inner wall of the second unit. Accordingly, oil is separated from the blow-by gas. This restricts the flow of blow-by gas containing oil toward the pressure sensor, thereby limiting reduction in the detection sensitivity of the pressure sensor. Further, the above-described configuration prevents the blow-by gas containing oil from being released into the intake passage.

In one example of the above-described internal combustion engine, when the internal combustion engine is in the position of being mounted, the second unit is located vertically above the first unit, and the partition plate constitutes a floor surface of the second space. The partition plate is inclined such that a section in which the constriction is provided is located at a lowest position.

The oil contained in the blow-by gas that has flowed into the second space strikes the wall surface of the second unit to be separated, and dribbles down to the partition plate, which constitutes the floor surface of the second space. The above-described configuration allows the oil that has dribbled down to the partition plate to flow down to the constriction under its own weight. Thus, when the operation of the internal combustion engine is stopped and inflow of blow-by gas to the second space through the constriction is stopped, the oil stored in the second space is returned to the first space, which is adjacent to the separator, through the constriction. This prevents the oil from flowing into the sensor connection line and the intake connection line. That is, the above-described configuration limits reduction in the detection sensitivity of the pressure sensor and thus limits reduction in the detection sensitivity to line disconnection due to reduction in the detection sensitivity of the pressure sensor.

In one example of the above-described internal combustion engine, the intake connection line connects the separator to a section of the intake passage that is on an upstream side of the throttle valve.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

An internal combustion engine 90 according to an embodiment will now be described with reference to FIGS. 1 to 4.

Figure 1:
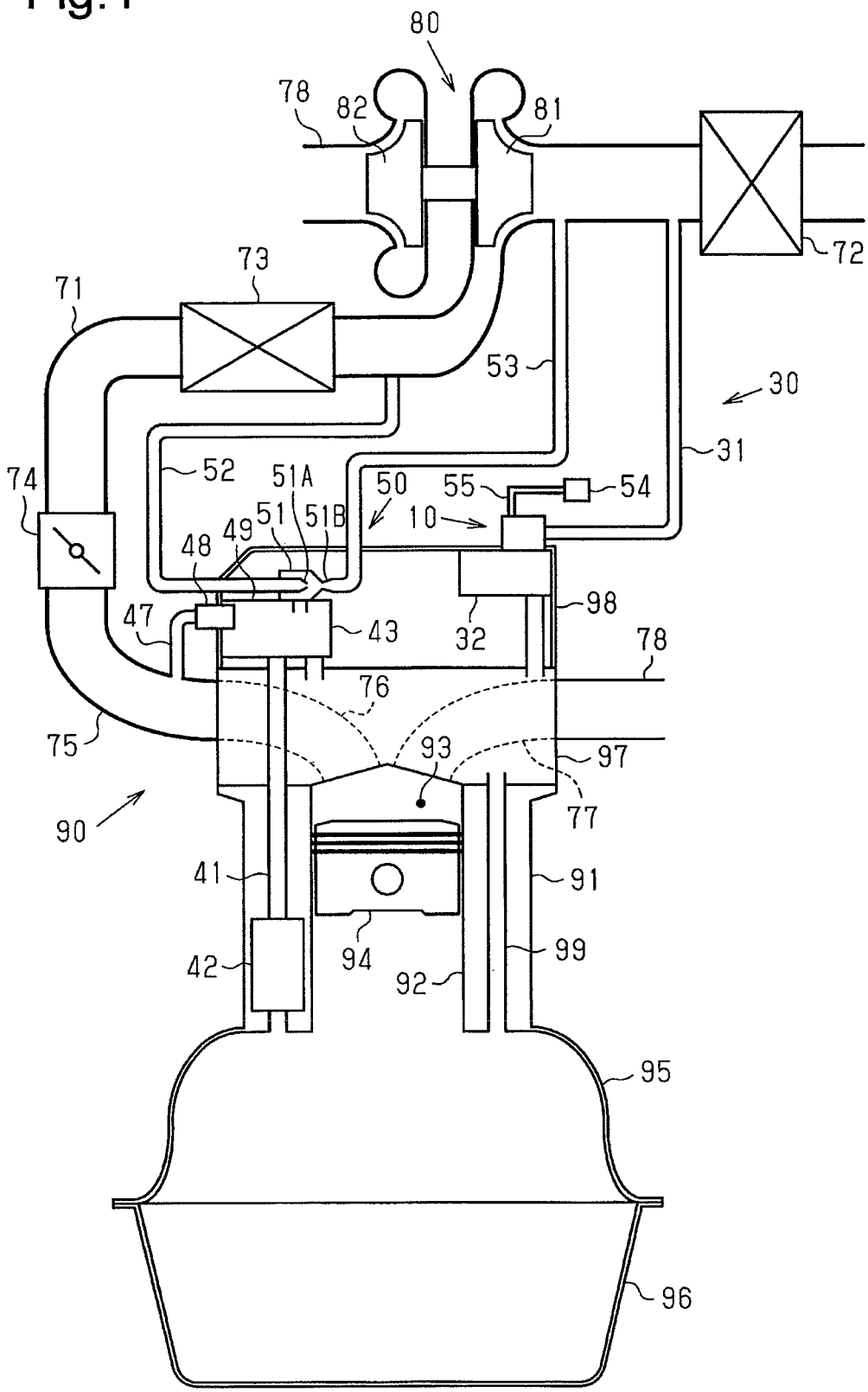
FIG. 1 is a schematic diagram showing an internal combustion engine according to an embodiment.

FIG. 1 shows the internal combustion engine 90, which is provided with a blow-by gas treating device 30.

The internal combustion engine 90 includes a cylinder block 91, a cylinder head 97, a head cover 98, a crankcase 95, and an oil pan 96.

The cylinder block 91 includes cylinders 92. Each cylinder 92 accommodates a piston 94. Each piston 94 reciprocates in conjunction with rotation of the crankshaft accommodated in the crankcase 95. The internal combustion engine 90 is a multi-cylinder engine.

The cylinder head 97 has intake valves and exhaust valves of the internal combustion engine 90. The head cover 98 is attached to the cylinder head 97 to cover the camshaft, which actuates the intake valves and the exhaust valves. The head cover 98 is made of plastic. A baffle plate (not shown) is attached to a part of the head cover 98 that is adjacent to the cylinder head 97.

The oil pan 96 stores oil used to lubricate components of the internal combustion engine 90 and to operate hydraulic mechanisms.

The internal combustion engine 90 includes combustion chambers 93, which are defined by the cylinders 92, the pistons 94 and the cylinder head 97. The internal combustion engine 90 includes an intake passage 71 configured to introduce air to the combustion chambers 93. The internal combustion engine 90 includes an exhaust passage 78 configured to discharge air-fuel mixture that has been burned in the combustion chambers 93.

The internal combustion engine 90 includes a forced-induction device 80 of an exhaust gas turbine type. The forced-induction device 80 includes a turbine 82 arranged in the exhaust passage 78. The forced-induction device 80 includes a compressor 81 arranged in the intake passage 71. The compressor 81 is integrally rotational with the turbine 82.

The internal combustion engine 90 includes an air cleaner 72 in a section of the intake passage 71 on the upstream side of the compressor 81. The internal combustion engine 90 further includes an intercooler 73 on the downstream side of the compressor 81. A throttle valve 74 is arranged on the downstream side of the intercooler 73. An intake manifold 75 is arranged on the downstream side of the throttle valve 74. The intake manifold 75 is connected to the cylinder head 97.

Intake air that has passed through the intake manifold 75 is introduced into the combustion chambers 93 through intake ports 76 provided in the cylinder head 97. The cylinder head 97 includes exhaust ports 77 configured to discharge exhaust gas from the combustion chambers 93. The exhaust gas discharged from the combustion chambers 93 is discharged to the exhaust passage 78.

The blow-by gas treating device 30 includes a blow-by gas passage 49, which connects the crankcase 95 and the intake passage 71 to each other. The blow-by gas treating device 30 delivers, to the intake passage 71, blow-by gas that has leaked from the combustion chambers 93 to the crankcase 95.

The blow-by gas treating device 30 includes a first separator 43, which is an oil separator arranged in the blow-by gas passage 49. The first separator 43 separates oil from blow-by gas. The first separator 43 is provided in the head cover 98. The first separator 43 is connected to the intake manifold 75 via a blow-by gas release line 47. A hose or a plastic pipe may be used as the blow-by gas release line 47. A PCV valve 48 is provided in the blow-by gas release line 47. The PCV valve 48 selectively connects and disconnects the first separator 43 to and from the intake manifold 75. The PCV valve 48 opens to connect the first separator 43 to the intake manifold 75 when the pressure in the intake manifold 75 is lower than the pressure in the first separator 43.

The blow-by gas treating device 30 includes a suction passage 41 configured to introduce the blow-by gas in the crankcase 95 to the first separator 43. The suction passage 41 is provided in the cylinder block 91 and the cylinder head 97. The suction passage 41 includes a pre-separator 42, which separates oil from the blow-by gas that passes through the suction passage 41.

The blow-by gas treating device 30 includes a fresh air introducing line 31 configured to introduce fresh air from the intake passage 71 to the crankcase 95. A hose or a plastic pipe may be used as the fresh air introducing line 31. One end of the fresh air introducing line 31 is connected to a section of the intake passage 71 between the air cleaner 72 and the compressor 81. The other end of the fresh air introducing line 31 is connected to a second separator 32, which is an oil separator provided in the head cover 98. The second separator 32 is defined by the head cover 98 and the baffle plate. The second separator 32 includes a line connection portion 10 to which the fresh air introducing line 31 is attached. A pressure sensor 54 is connected to the line connection portion 10 via a sensor connection line 55. The pressure sensor 54 detects the pressure in the fresh air introducing line 31. The detection signal of the pressure sensor 54 is delivered to the control unit (not shown) of the internal combustion engine 90. The control unit includes a detection section that detects the pressure in the fresh air introducing line 31 based on the detection signal of the pressure sensor 54. The detection section detects that the fresh air introducing line 31 is disconnected when a change in the detected pressure is increased to exceed a specified range.

The cylinder block 91 includes a communicating passage 99, which communicates with the crankcase 95. The intake passage 71 is connected to the crankcase 95 via the fresh air introducing line 31 and the second separator 32. Hereinafter, the passage that includes the fresh air introducing line 31 and connects the intake passage 71 to the crankcase 95 will be referred to as a fresh air introducing passage in some cases.

The blow-by gas treating device 30 includes an ejector 50, which generates negative pressure in conjunction with the operation of the forced-induction device 80. The ejector 50 includes an ejector main body 51 connected to the first separator 43. The ejector main body 51 is connected to a first intake air circulation line 52 and a second intake air circulation line 53. The first intake air circulation line 52 is connected to a section of the intake passage 71 between the compressor 81 and the intercooler 73. The second intake air circulation line 53 is connected to a section of the intake passage 71 between the air cleaner 72 and the compressor 81. The joint between the second intake air circulation line 53 and the intake passage 71 is located on the downstream side of the joint between the fresh air introducing line 31 and the intake passage 71. The ejector main body 51 includes a nozzle 51A, which ejects intake air supplied via the first intake air circulation line 52 toward the second intake air circulation line 53. The ejector main body 51 includes a diffuser 51B, which is located closer to the second intake air circulation line 53 than the nozzle 51A. The diffuser 51B has a gas flow path that is gradually enlarged. The ejector 50 is constituted by the ejector main body 51, the first intake air circulation line 52, and the second intake air circulation line 53.

When the internal combustion engine 90 is not operating in the forced-induction region and the pressure in the intake manifold 75 is lower than the pressure in the first separator 43, the PCV valve 48 opens to deliver the blow-by gas in the first separator 43 to the intake passage 71. At this time, the blow-by gas in the crankcase 95 is drawn into the first separator 43 via the suction passage 41. Also, intake air is drawn into the crankcase 95 from the intake passage 71 via the fresh air introducing passage.

In contrast, when the internal combustion engine 90 is operating in the forced-induction region, the difference between the intake pressure on the upstream side of the compressor 81 and the intake pressure on the downstream side of the compressor 81 causes the intake air that has been flowed into the first intake air circulation line 52 from the section of the intake passage 71 on the downstream side of the compressor 81 to return to the section on the upstream side of the compressor 81 via the ejector main body 51 and the second intake air circulation line 53. When the intake air passes through the nozzle 51A of the ejector main body 51, negative pressure is generated inside the ejector main body 51. At this time, the ejector 50 draws in the blow-by gas in the crankcase 95 via the first separator 43 and releases the blow-by gas that has passed through the diffuser 51B to the intake passage 71 via the second intake air circulation line 53.

When the internal combustion engine 90 is operating in the forced-induction region, the pressure of the blow-by gas leaking from the combustion chambers 93 to the crankcase 95 is relatively high. When the pressure in the crankcase 95 is higher than the internal pressure of the section of the intake passage 71 to which the fresh air introducing line 31 is connected, the blow-by gas in the crankcase 95 flows into the intake passage 71 via the fresh air introducing passage. Even when the internal combustion engine 90 is not operating in the forced-induction region, if the throttle valve 74 is fully open, for example, the blow-by gas leaking from the combustion chambers 93 to the crankcase 95 may flow into the intake passage 71 via the fresh air introducing passage.

The line connection portion 10 will be described with reference to FIGS. 2 to 4. FIG. 3 shows arrows indicating the vertical direction and the horizontal direction of the internal combustion engine 90 in the position of being mounted on the vehicle.

Figure 2:
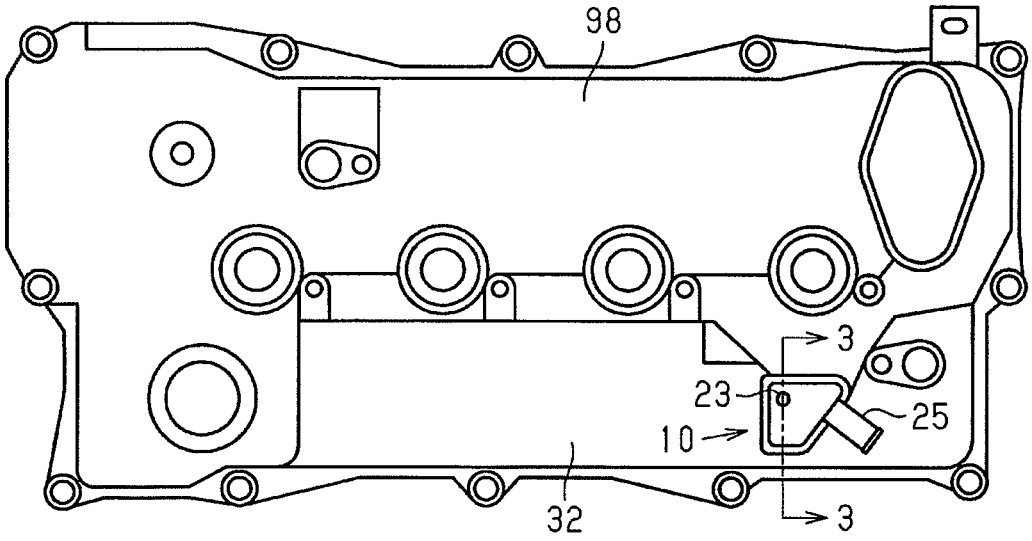
FIG. 2 is a front view showing the head cover of the internal combustion engine of the embodiment.
Figure 3:
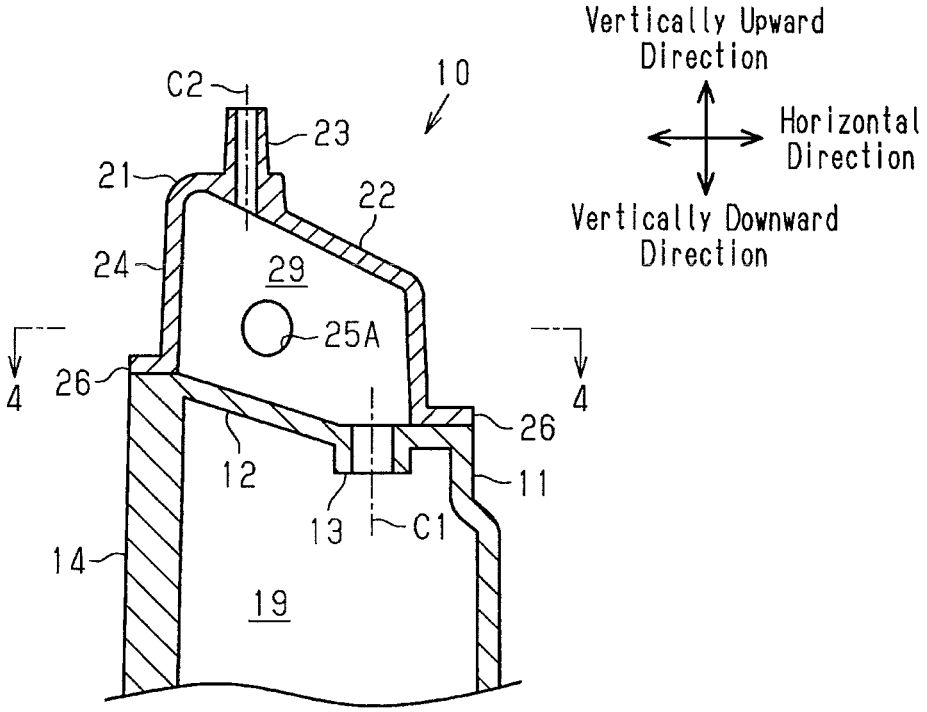
FIG. 3 is a cross-sectional view taken along line 3-3 of FIG. 2.

FIG. 2 illustrates the head cover 98. The line connection portion 10 of the second separator 32 includes an intake connection union 25, to which the fresh air introducing line 31 is connected. The intake connection union 25 is inserted into the fresh air introducing line 31 so that the fresh air introducing line 31 and the line connection portion 10 are connected to each other. The line connection portion 10 includes a sensor connection union 23, to which the sensor connection line 55 is connected. The sensor connection union 23 is inserted into the sensor connection line 55 so that the sensor connection line 55 and the line connection portion 10 are connected to each other.

As shown in FIG. 3, the line connection portion 10 includes a partition plate 12, which divides the space inside the second separator 32 into a first space 19 and a second space 29. The first space 19 and the second space 29 are arranged in the vertical direction. In the fresh air introducing passage, the second space 29 is located at a position closer to the intake passage 71 than the first space 19. The partition plate 12 has a constriction 13, through which the first space 19 and the second space 29 communicate with each other. FIG. 3 shows a first axis C1, which is defined as the central axis of an opening 13A of the constriction 13. The partition plate 12 is inclined such that the section in which the constriction 13 is provided is located at the lowest position.

The line connection portion 10 is constituted by combining a first unit 11, which defines the first space 19, and a second unit 21, which defines the second space 29.

The first unit 11, which constitutes the line connection portion 10, is provided integrally with the head cover 98. The partition plate 12 is the top plate of the first unit 11. The first space 19 is defined by a first side wall 14 and the partition plate 12 of the first unit 11.

The second unit 21, which constitutes the line connection portion 10, is located vertically above the first unit 11 and is shaped as a box with the side adjacent to the first unit 11 open. Like the first unit 11 (the head cover 98), the second unit 21 is made of plastic. The second unit 21 includes a flange 26, to which the first unit 11 is welded. The second space 29 is surrounded by a second side wall 24 of the second unit 21, which extends vertically upward from the flange 26. A top plate 22 is provided at the upper end of the second side wall 24 in the vertical direction. The second space 29 is defined by the partition plate 12 of the first unit 11 and the top plate 22 and the second side wall 24 of the second unit 21. That is, the partition plate 12 constitutes the floor surface of the second space 29.

As shown in FIGS. 2 and 3, the sensor connection union 23 is provided on the top plate 22 of the second unit 21. The sensor connection union 23 extends in the vertical direction. FIG. 3 shows a second axis C2, which is defined as the central axis of the passage in the sensor connection union 23. The top plate 22 is inclined relative to the horizontal direction, and the sensor connection union 23 is provided in a section of the top plate 22 closer to the top.

Figure 4:
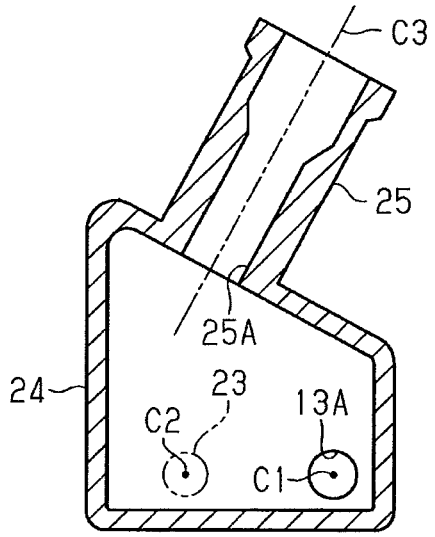
FIG. 4 is a cross-sectional view taken along line 4-4 of FIG. 3.

As shown in FIGS. 2 and 4, the intake connection union 25 is provided in the second side wall 24 of the second unit 21. FIGS. 3 and 4 illustrate an open end 25A of the intake connection union 25, which opens in the second side wall 24. FIG. 4 shows a third axis C3, which is defined as the central axis of the passage in the intake connection union 25.

As shown in FIGS. 3 and 4, the constriction 13 and the sensor connection union 23 are arranged at positions in the line connection portion 10 where the first axis C1 and the second axis C2 are displaced from each other. In other words, the constriction 13 and the sensor connection union 23 are arranged at positions where the first axis C1 and the second axis C2 are non-coaxial. The constriction 13 and the sensor connection union 23 are arranged such that the first axis C1 and the second axis C2 are not arranged on the same straight line. In the present embodiment, the first axis C1 and the second axis C2 are parallel with each other and do not intersect with each other as shown in FIG. 3. That is, the first axis C1 and the second axis C2 are non-crossing. As shown in FIG. 4, in the second unit 21, the sensor connection union 23 and the intake connection union 25 are arranged at positions where the second axis C2 and the third axis C3 do not intersect with each other. In other words, the sensor connection union 23 and the intake connection union 25 are arranged at positions where the second axis C2 and the third axis C3 are non-crossing. Further, the intake connection union 25 is arranged at a position where the first axis C1 and the third axis C3 do not intersect with each other. In other words, the intake connection union 25 is arranged at a position where the first axis C1 and the third axis C3 are non-crossing. That is, in the line connection portion 10, the second axis C2 and the third axis C3 are at positions of skew lines, and the first axis C1 and the third axis C3 are at positions of skew lines. As described above, in the line connection portion 10, the constriction 13, the sensor connection union 23, and the intake connection union 25 are arranged at positions where any two of the first axis C1, the second axis C2, and the third axis C3 do not intersect with each other, that is, are non-crossing.

Operation and advantages of the present embodiment will now be described.

The internal combustion engine 90 includes the line connection portion 10. The line connection portion 10 includes the intake connection union 25 between the constriction 13 and the sensor connection union 23, to which the pressure sensor 54 is connected. Thus, in both of a case in which the fresh air introducing line 31 is disconnected at the joint with the intake passage 71 and a case in which the fresh air introducing line 31 is disconnected at the joint with the line connection portion 10, the part in which the sensor connection union 23 is provided is exposed to the atmosphere after the fresh air introducing line 31 is disconnected. The detection value of the pressure sensor 54 thus readily approaches the atmospheric pressure. That is, when the fresh air introducing line 31 is disconnected, the line disconnection is detected through a change in the detection value of the pressure sensor 54.

The blow-by gas that has leaked from the combustion chambers 93 contains oil and passes through the communicating passage 99. Although the second separator 32 traps some of the oil in the blow-by gas, oil that has not been separated may enter the line connection portion 10. If oil enters the line connection portion 10 and collects on the pressure sensor 54, which is connected to the line connection portion 10, the detection sensitivity of the pressure sensor 54 may be reduced. However, with the line connection portion 10 of the internal combustion engine 90, the sensor connection union 23 is located vertically above the constriction 13 even if oil enters the second space 29 after passing through the constriction 13 together with blow-by gas. This prevents the oil that has entered the second space 29 from reaching the pressure sensor 54 through the sensor connection union 23. Accordingly, oil is prevented from collecting on the pressure sensor 54. That is, the present embodiment limits reduction in the detection sensitivity of the pressure sensor 54 and thus limits reduction in the detection sensitivity to line disconnection due to reduction in the detection sensitivity of the pressure sensor 54.

The blow-by gas also contains water. Since the sensor connection union 23 is located vertically above the constriction 13, the water contained in the blow-by gas is prevented from reaching the pressure sensor 54.

Further, in the line connection portion 10 of the internal combustion engine 90, the constriction 13 and the sensor connection union 23 are arranged at positions where the first axis C1 and the second axis C2 are displaced from each other. The constriction 13, the sensor connection union 23, and the intake connection union 25 are arranged at positions where any two of the first axis C1, the second axis C2, and the third axis C3 do not intersect with each other. Thus, the blow-by gas that flows into the second space 29 through the constriction 13 flows toward the top plate 22 of the second unit 21. That is, the present embodiment prevents the blow-by gas flowing into the second space 29 from directly flowing into the sensor connection line 55. Further, the present embodiment prevents the blow-by gas that flows into the second space 29 from directly flowing into the fresh air introducing line 31. Also, when blow-by gas passes through the constriction 13, which has a small cross-sectional flow area, its flow velocity is increased. Thus, in the line connection portion 10, blow-by gas readily strikes the top plate 22 of the second unit 21. As described above, blow-by gas readily strikes the inner wall of the second unit 21. This allows oil to be separated from the blow-by gas, thereby limiting reduction in the detection sensitivity of the pressure sensor 54 due to the flow of blow-by gas containing oil toward the pressure sensor 54. That is, the present embodiment limits reduction in the detection sensitivity to line disconnection due to reduction in the detection sensitivity of the pressure sensor 54.

Since the blow-by gas flowing into the second space 29 is prevented from directly flowing into the fresh air introducing line 31, the blow-by gas containing oil is prevented from being released to the intake passage 71.

Further, any two of the first axis C1, the second axis C2, and the third axis C3 do not intersect with each other. This reduces the influence of pulsation of the blow-by gas passing through the line connection portion 10 on the detection value of the pressure sensor 54. That is, the present embodiment limits reduction in the detection sensitivity of the pressure sensor 54 and thus limits reduction in the detection sensitivity to line disconnection due to reduction in the detection sensitivity of the pressure sensor 54.

In the line connection portion 10 of the internal combustion engine 90, oil contained in the blow-by gas that has flowed into the second space 29 strikes the wall surface of the second unit 21 to be separated and dribbles down to the partition plate 12, which constitutes the floor surface of the second space 29. The partition plate 12 is inclined such that the section in which the constriction 13 is provided is located at the lowest position. This allows the oil that has dribbled down to the partition plate 12 to flow down to the constriction 13 under its own weight. Thus, when the operation of the internal combustion engine 90 is stopped and inflow of blow-by gas to the second space 29 through the constriction 13 is stopped, the oil stored in the second space 29 is returned to the first space 19, which is adjacent to the second separator 32, through the constriction 13. This prevents oil from flowing into the sensor connection line 55 and the fresh air introducing line 31. That is, the present embodiment limits reduction in the detection sensitivity of the pressure sensor 54 and thus limits reduction in the detection sensitivity to line disconnection due to reduction in the detection sensitivity of the pressure sensor 54.

The line connection portion 10 of the present embodiment includes the second unit 21, which includes the sensor connection union 23 and the intake connection union 25, is welded to the first unit 11, which includes the constriction 13. Since the line connection portion 10 is divided into two units, the line connection portion 10 is relatively easily formed using plastic. In this regard, a line connection portion 110 shown in FIG. 5 will now be described as a comparative example.

Figure 5:
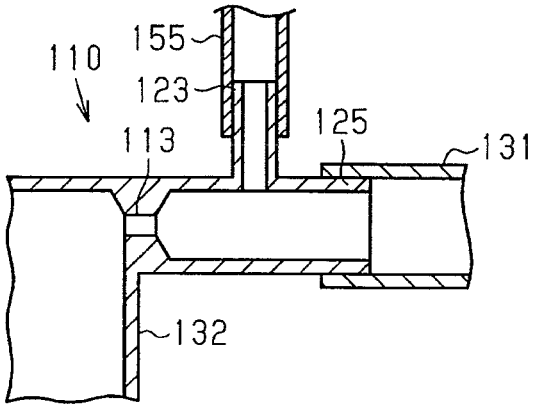
FIG. 5 is a cross-sectional view of a line connection portion in an internal combustion engine of a comparative example.

FIG. 5 shows, as a comparative example, the line connection portion 110, which is provided in a separator 132. The line connection portion 110 and the separator 132 are made of plastic. The line connection portion 110 is integrally molded with the separator 132. The line connection portion 110 includes an intake connection union 125 and a sensor connection union 123. The intake connection union 125 is connected to an intake connection line 131, which is connected to the intake passage. The sensor connection union 123 is connected to a sensor connection line 155, to which a pressure sensor is connected. As illustrated in the drawing, the line connection portion 110 is branched into two sections between a constriction 113 and the intake connection line 131. The intake connection union 125 and the sensor connection union 123 are arranged at the two branched sections, respectively.

When performing plastic molding through injection molding using molds, the movable mold plate is moved to approach the fixed mold plate. Then, the cavity between the fixed mold plate and the movable mold plate is filled with plastic. After the plastic solidifies, the movable mold plate is moved away from the fixed mold plate, and the molded product is removed. Further, when forming a union in the separator 132 (head cover) as in the case of the line connection portion 110 shown in FIG. 5, a slide core is additionally used to form a passage in the union. In this case, a columnar slide core is moved in the direction in which the passage in the union extends when the fixed mold plate and the movable mold plate approach or move away from each other. However, in a case in which the sensor connection union 123 is branched off the intake connection union 125 as in the case of the line connection portion 110, slide cores of different moving directions interfere with each other at the branching portion. This may complicate the molding process or require a secondary working after removing the product from the mold.

In contrast, the second unit 21 of the line connection portion 10 of the present embodiment has an open side adjacent to the first unit 11. That is, the inner wall of the second unit 21 can be molded by the movable mold plate. During molding, the movable mold plate is located at the part corresponding to the second space 29. Thus, the slide core for molding the intake connection union 25 and the slide core for molding the sensor connection union 23, which are slide cores of different moving directions, do not interfere with each other. In this manner, the line connection portion 10 of the present embodiment can be formed through injection molding without any constraints on the molds and is thus easier to manufacture than the line connection portion 110 shown in FIG. 5.

The correspondence between the items in the above-described embodiment and the items described in the above BACKGROUND is as follows.

The second separator 32 corresponds to "the separator that separates oil from blow-by gas." The fresh air introducing line 31 corresponds to "the intake connection line that connects the intake passage and the separator to each other."

The above-described embodiment may be modified as follows. The above-described embodiment and the following modifications can be combined as long as the combined modifications remain technically consistent with each other.

Figure 6:
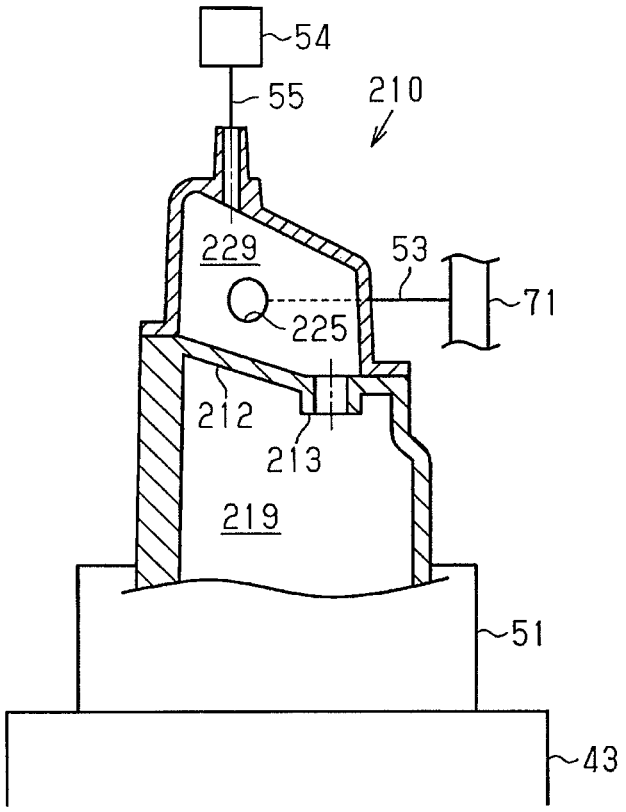
FIG. 6 is a schematic diagram showing a line connection portion of an internal combustion engine of a modification.

The configuration of the line connection portion 10 of the above-described embodiment may be applied to the ejector 50. FIG. 6 illustrates an example in which a line connection portion 210 is provided between the ejector main body 51 and the second intake air circulation line 53.

As shown in FIG. 6, the line connection portion 210 is provided in the ejector main body 51 such that a first space 219 is located at a position that is closer to the second intake air circulation line 53 than the diffuser 51B of the ejector main body 51. A second space 229, which is separated from the first space 219 by a partition plate 212, is located vertically above the first space 219. The partition plate 212 has a constriction 213. The sensor connection line 55, to which the pressure sensor 54 is connected, is attached to the sensor connection union of the line connection portion 210. A pipe constituting the second intake air circulation line 53 is attached to an intake connection union 225 of the line connection portion 210. The constriction 213 may be used as the diffuser 51B of the ejector 50. This configuration allows the pressure sensor 54 to detect line disconnection of the second intake air circulation line 53 as in the case of the above-described embodiment. Further, as in the case of the above-described embodiment, oil is trapped from the blow-by gas discharged from the intake passage 71, which prevents oil from entering the intake passage 71.

The correspondence between the items in the above-described embodiment and the items described in the above BACKGROUND is as follows. The first separator 43, to which the ejector main body 51 is attached, corresponds to "the separator that separates oil from blow-by gas." The second intake air circulation line 53 corresponds to "the intake connection line that connects the intake passage and the separator to each other."

Figure 7:
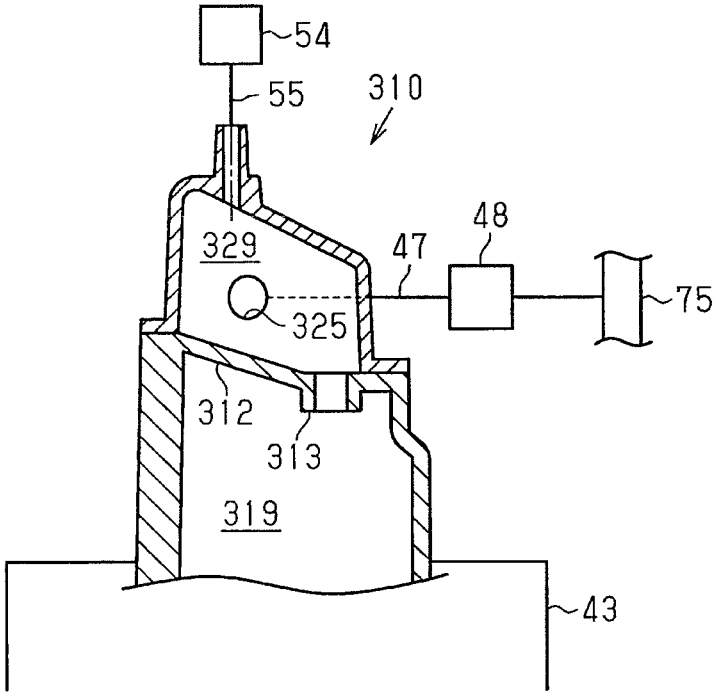
FIG. 7 is a schematic diagram showing a line connection portion of an internal combustion engine of another modification.

The configuration of the line connection portion 10 of the above-described embodiment may be applied to the blow-by gas passage 49. FIG. 7 illustrates an example in which a line connection portion 310 is provided between the first separator 43 and the blow-by gas release line 47.

As shown in FIG. 7, the line connection portion 310 connects the blow-by gas release line 47 to the first separator 43 and includes an intake connection union 325, to which the blow-by gas release line 47 is attached. A PCV valve 48 is provided in the blow-by gas release line 47. The PCV valve 48 selectively connects and disconnects the line connection portion 310 to and from the intake manifold 75. Also, the sensor connection line 55, to which the pressure sensor 54 is connected, is attached to the sensor connection union of the line connection portion 310. The line connection portion 310 includes a partition plate 312, which divides the space inside the first separator 43 into a first space 319 and a second space 329. The partition plate 312 has a constriction 313.

In the configuration shown in FIG. 7, when the blow-by gas release line 47 is disconnected at the joint with the intake connection union 325, the detection value of the pressure sensor 54 approaches the atmospheric pressure. This allows the line disconnection to be detected. In this manner, when the line disconnection occurs at a position closer to the line connection portion 310 than the PCV valve 48, the pressure sensor 54 can detect the line disconnection. In contrast, when the blow-by gas release line 47 is disconnected at the joint with the intake manifold 75, the PCV valve 48 is connected to the line connection portion 310 and the first separator 43. The detection value of the pressure sensor 54 is unlikely to change, so that the pressure sensor 54 is unable to detect the line disconnection. In this case, however, the blow-by gas release line 47 is disconnected from the intake manifold 75, so that the intake manifold 75 is opened. Accordingly, the operating state of the internal combustion engine 90 is likely to change. Line disconnection is detected based on such a change in the operating state of the internal combustion engine 90.

This configuration allows the pressure sensor 54 to detect line disconnection of the blow-by gas release line 47 as in the case of the above-described embodiment. Further, as in the case of the above-described embodiment, oil can be trapped from the blow-by gas discharged to the intake manifold 75 of the intake passage 71, which prevents oil from entering the intake passage 71.

The correspondence between the items in the above-described embodiment and the items described in the above BACKGROUND is as follows. The first separator 43 corresponds to "the separator that separates oil from blow-by gas." The blow-by gas release line 47 corresponds to "the intake connection line that connects the intake passage and the separator to each other."

In the above-described embodiment, the partition plate 12 is inclined. However, the partition plate 12 may be arranged to be horizontal. Also, a partition plate with a center portion recessed vertically downward may be used so that the floor surface of the second space 29 has a bowl shape. In this case, the opening 13A of the constriction 13 may be provided in the portion that is recessed vertically downward.

The above-described embodiment is configured such that any two of the first axis C1, the second axis C2, and the third axis C3 do not intersect with each other. However, the intake connection union 25 may be provided such that the third axis C3 and the first axis C1 intersect with each other, or the third axis C3 and the second axis C2 intersect with each other. If the constriction 13 and the sensor connection union 23 are arranged at positions where the first axis C1 and the second axis C2 are displaced from each other, the blow-by gas that flows into the second space 29 after passing through the constriction 13 readily strikes the top plate 22 of the second unit 21. That is, the above-described embodiment prevents the blow-by gas flowing into the second space 29 from directly flowing into the sensor connection line 55.

In the above-described embodiment, the intake connection union 25 is provided in the second side wall 24 of the second unit 21. The intake connection union 25 may be provided in the top plate 22 of the second unit 21.

The above-described embodiment describes the line connection portion 10, in which the first space 19 and the second space 29 are arranged in the vertical direction. However, the line connection portion is not limited to this. For example, the first space 19 and the second space 29 may be arranged in the horizontal direction.

Even in a line connection portion in which the first space 19 and the second space 29 are not arranged vertically, line disconnection can be detected by the pressure sensor 54 if the first unit 11 includes the constriction 13, and the second unit 21 includes the intake connection union 25 and the sensor connection union 23.

Further, if the sensor connection union 23 is located vertically above the constriction 13, it is possible to prevent oil from collecting on the pressure sensor 54.

Also, if the constriction 13 and the sensor connection union 23 are arranged at positions where the first axis C1 and the second axis C2 are displaced from each other, it is possible to cause blow-by gas to strike the inner wall of the second unit 21 to trap oil in the second space 29.

In the above-described embodiment, the pressure sensor 54 is connected to the line connection portion 10 via the sensor connection line 55. However, the sensor connection line 55 may be omitted and the pressure sensor 54 may be directly connected to the sensor connection union 23 of the line connection portion 10. That is, the shape of the sensor connection union 23, which is an example of the shape into which the sensor connection line 55 is inserted, may be changed to a shape to which the pressure sensor 54 can be connected. This allows the sensor connection line 55 to be omitted and the pressure sensor 54 to be directly connected to the sensor connection union 23 of the line connection portion 10.

In the above-described embodiment, the first unit 11 of the line connection portion 10 and the head cover 98 are molded integrally. The first unit 11 and the head cover 98 may be molded separately and combined together.

Although the internal combustion engine 90 of the above-described embodiment is provided with the forced-induction device 80, a forced-induction device is not necessarily required. Even in an internal combustion engine without a forced-induction device, the line connection portion 10 is able to detect line disconnection of the fresh air introducing line 31 by using the pressure sensor 54 as in the case of the above-described embodiment. Also, even in an internal combustion engine without a forced-induction device, if the throttle valve 74 is fully open, blow-by gas leaking from the combustion chambers 93 to the crankcase 95 may flow into the intake passage 71 via the fresh air introducing passage. Accordingly, when blow-by gas passes through the fresh air introducing passage, oil is prevented from collecting on the pressure sensor 54 as in the case of the above-described embodiment.

When the internal combustion engine 90 of the above-described embodiment is operating in the forced-induction region, the ejector 50 generates negative pressure to discharge blow-by gas to the intake passage 71. However, the ejector 50 may be omitted. In this case, when the internal combustion engine 90 is operating in the forced-induction region, blow-by gas can be discharged to the intake passage via the fresh air introducing passage.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. An internal combustion engine comprising a blow-by gas treating device, wherein the blow-by gas treating device includes a blow-by gas passage configured to release blow-by gas that has leaked to a crankcase from a combustion chamber of the internal combustion engine to a section of an intake passage that is on a downstream side of a throttle valve, a separator configured to separate oil from the blow-by gas, an intake connection line that connects the intake passage to the separator, and a pressure sensor configured to detect pressure in the intake connection line, the separator includes a line connection portion, the line connection portion includes an intake connection union attached to the intake connection line, a sensor connection union to which the pressure sensor is connected, a partition plate that divides a space in the separator into a first space and a second space, and a constriction that is provided in the partition plate and allows the first space and the second space to communicate with each other, the line connection portion is constituted by combining a first unit, which includes the partition plate and defines the first space, and a second unit, which defines the second space with the partition plate of the first unit, and the intake connection union and the sensor connection union are provided in the second unit.

2. The internal combustion engine according to claim 1, wherein, when the internal combustion engine is in a position of being mounted, the sensor connection union is located vertically above the constriction.

3. The internal combustion engine according to claim 2, wherein a central axis of an opening of the constriction is defined as a first central axis, a central axis of the sensor connection union is defined as a second central axis, and the constriction and the sensor connection union are arranged at positions where the first central axis and the second central axis are displaced from each other.

4. The internal combustion engine according to claim 3, wherein a central axis of the intake connection union is defined as a third central axis, and the constriction, the sensor connection union, and the intake connection union are arranged at positions where any two of the first central axis, the second central axis, and the third central axis do not intersect with each other.

5. The internal combustion engine according to claim 2, wherein when the internal combustion engine is in the position of being mounted, the second unit is located vertically above the first unit, and the partition plate constitutes a floor surface of the second space, and the partition plate is inclined such that a section in which the constriction is provided is located at a lowest position.

6. The internal combustion engine according to claim 1, wherein the intake connection line connects the separator to a section of the intake passage that is on an upstream side of the throttle valve.

* * * * *